US008240382B2

(12) United States Patent
Krush

(10) Patent No.: US 8,240,382 B2
(45) Date of Patent: Aug. 14, 2012

(54) CONSTANT PRESSURE OPEN HOLE WATER PACKING SYSTEM

(75) Inventor: Robert Krush, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 267 days.

(21) Appl. No.: 12/642,950

(22) Filed: Dec. 21, 2009

(65) Prior Publication Data

US 2011/0146984 A1 Jun. 23, 2011

(51) Int. Cl.
*E21B 43/04* (2006.01)

(52) U.S. Cl. ..... 166/278; 166/51

(58) Field of Classification Search ..... 166/51, 166/106, 157, 278
See application file for complete search history.

(56) References Cited

U.S. PATENT DOCUMENTS

| | | | | |
|---|---|---|---|---|
| 3,999,608 | A * | 12/1976 | Smith | 166/278 |
| 6,328,103 | B1 * | 12/2001 | Pahmiyer et al. | 166/250.17 |
| 6,837,313 | B2 * | 1/2005 | Hosie et al. | 175/25 |
| 7,128,152 | B2 | 10/2006 | Anyan et al. | |
| 7,128,160 | B2 | 10/2006 | Anyan et al. | |
| 7,543,641 | B2 * | 6/2009 | Contant | 166/278 |
| 2002/0036087 | A1 * | 3/2002 | Bixenman et al. | 166/278 |
| 2003/0066651 | A1 | 4/2003 | Johnson | |
| 2004/0069501 | A1 * | 4/2004 | Haugen et al. | 166/381 |
| 2004/0094307 | A1 | 5/2004 | Daling et al. | |
| 2005/0045337 | A1 * | 3/2005 | Bansal et al. | 166/369 |
| 2005/0092488 | A1 * | 5/2005 | Rodet et al. | 166/278 |
| 2006/0219405 | A1 | 10/2006 | Nguyen et al. | |
| 2011/0120704 | A1 * | 5/2011 | Best | 166/269 |

* cited by examiner

*Primary Examiner* — William P Neuder
*Assistant Examiner* — Blake Michener
(74) *Attorney, Agent, or Firm* — David G. Matthews; Rodney Warfford; Robert Van Someren

(57) ABSTRACT

A system for conveying fluid into a wellbore, including a tubular member, a packer, a hydrodynamic flow device, and a seal device. The tubular member is disposed in the wellbore through a first zone, a second zone, and a hydrocarbon producing zone of the wellbore. The packer is disposed adjacent to the tubular member, and is configured to at least partially isolate the hydrocarbon producing zone from at least one of the first and second zones. The hydrodynamic flow device is disposed around the tubular member and comprises a pump fluidly connected to a discharge in fluid communication with the first zone and an inlet in fluid communication with the second zone. The seal device is disposed around the hydrodynamic flow device to isolate a first annulus of the first zone from a second annulus of the second zone.

23 Claims, 4 Drawing Sheets

CONSTANT PRESSURE OPEN HOLE WATER PACKING SYSTEM

BACKGROUND

Hydrocarbon producing formations often have sand commingled with the hydrocarbons to be produced. For various reasons, it is not desirable to produce the commingled sand to the earth's surface. Thus, sand control completion techniques are used to prevent the production of sand.

A commonly used sand-control technique is a gravel pack or water pack. Gravel packs utilize a screen or the like that is lowered into the borehole and positioned adjacent a hydrocarbon producing zone that is to be completed. Particulate material, collectively referred to as "gravel," is then forced or pumped as slurry around the screen between the screen and the formation. The liquid in the slurry flows into the formation and/or through the openings in the screen, resulting in the gravel being deposited or "screened out" in an annulus formed in the borehole between the screen and the borehole. The gravel forms a permeable mass or "pack" between the screen and the producing formation. The gravel pack allows flow of the produced fluids therethrough while substantially blocking the flow of any formation particulate material, e.g., sand, into the borehole.

The pumping of the gravel into the wellbore presents several challenges. One challenge is that pressure exceeding the fracture pressure of the formation is often exerted on the formation. If the formation fractures, the gravel pack treatment typically has to be terminated. There is a need, therefore, for systems and methods of gravel packing a wellbore and maintaining the pressure exerted on the formation below the fracture pressure of the formation.

SUMMARY

Embodiments of the disclosure may provide an exemplary system for conveying fluid into a wellbore, including a tubular member, a packer, a hydrodynamic flow device, and a seal device. The tubular member is disposed in the wellbore through a first zone, a second zone, and a hydrocarbon producing zone of the wellbore. The packer is disposed adjacent to the tubular member in the wellbore, and is configured to at least partially isolate the hydrocarbon producing zone from at least one of the first and second zones. The hydrodynamic flow device is disposed around the tubular member and comprises a pump fluidly connected to a discharge in fluid communication with the first zone and an inlet in fluid communication with the second zone. The seal device is disposed around the hydrodynamic flow device to isolate a first annulus of the first zone from a second annulus of the second zone.

Embodiments of the disclosure may also provide an exemplary apparatus for controlling pressure in a wellbore including a tubular member, a hydrodynamic flow device, a service tool, a wash pipe, and a filter media. The tubular member is disposed in the wellbore through a first zone, a second zone, and a hydrocarbon producing zone of the wellbore and is in fluid communication with a source of a proppant. The hydrodynamic flow device is disposed in the wellbore and around the tubular member and comprises a pump having a discharge in fluid communication with the first zone and an inlet in fluid communication with the second zone. The service tool is disposed on the tubular member, distal the hydrodynamic flow device, and has a flow port defined therein in fluid communication an annulus defined between the tubular member and the wellbore. The wash pipe is adjacent the service tool, wherein the wash pipe has an inner diameter in fluid communication with the flow port. The filter media is disposed about the wash pipe, wherein the inner diameter of the wash pipe is in fluid communication with an exterior of the filter media.

Embodiments of the disclosure may also provide an exemplary method of gravel packing a wellbore. The exemplary method may include positioning a tubular member down the wellbore through a first zone, a second zone distal the first zone, and a hydrocarbon producing zone, and isolating the first zone from the second zone with a sealing device. The exemplary method may also include circulating a gravel slurry through the tubular member into a wash pipe and through an opening in the wash pipe into a filter media, and filtering the gravel slurry with the filter media to gravel pack an area outside of the filter media while allowing a flow of fluid therethrough into an annulus between the tubular member and the wellbore. The exemplary method may further include controlling a flow rate through the tubular member to control a pressure in the hydrocarbon producing zone, comprising adjusting a discharge pressure of a hydrodynamic flow device positioned on the tubular member and having a discharge in communication with the first zone and an inlet in fluid communication with the second zone.

BRIEF DESCRIPTION OF THE DRAWINGS

So that the recited features can be understood in detail, a more particular description, briefly summarized above, may be had by reference to one or more embodiments, some of which are illustrated in the appended drawings. It is to be noted, however, that the appended drawings illustrate only typical embodiments and are therefore not to be considered limiting of its scope, for the invention may admit to other equally effective embodiments.

DETAILED DESCRIPTION

Figure 1:
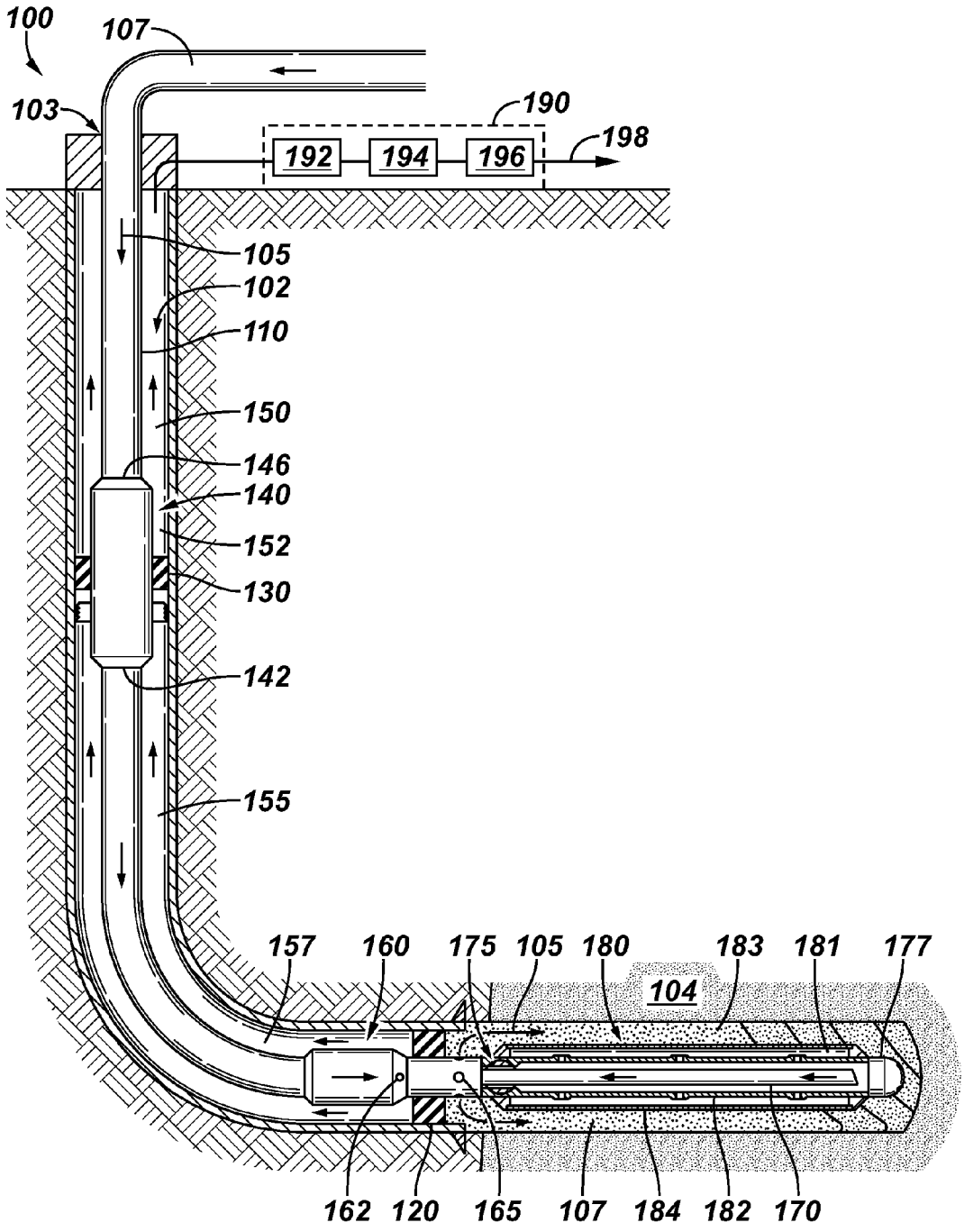
FIG. 1 depicts a schematic view of an illustrative system for providing fluid to a wellbore disposed within a wellbore, according to one or more embodiments described.

FIG. 1 depicts a schematic view of an illustrative system 100 for providing fluid to a wellbore 102, wherein the system 100 is at least partially disposed within the wellbore 102. The system 100 can include a tubular member 110, which can have one or more hydrodynamic flow devices 140 disposed along its length. The tubular member 110 can also have one or more service tools 160, one or more wash pipes 170, one or more screen assemblies 180, and one or more monitoring and control systems 190 in communication therewith. One or more packers 120 can be disposed on, for example, circumferentially around, the tubular member 110 and/or the service tool 160. The tubular member 110 can be located within the wellbore 102 and the packer 120 can isolate a portion of the wellbore 102 adjacent a hydrocarbon producing zone 104 from other portions of the wellbore 102. A seal device 130 can be disposed proximal the hydrodynamic flow device 140, for example, circumferentially around the hydrodynamic flow device 140. The seal device 130 can isolate a first zone 150 from a second zone 155 of the wellbore 102 from one another.

The system 100 can provide a continuous flow path for fluids, and can convey or provide one or more fluids into the wellbore 102 adjacent the hydrocarbon producing zone 104, as shown by the arrows in FIG. 1. The fluids 105 can be treatment fluid, acid, gel, water, or other fluids for performing one or more hydrocarbon services. In one or more exemplary embodiments, the fluid can be a gravel slurry and can include a viscous or carrier fluid and a proppant 107. The system 100 can also be used to produce hydrocarbons from the hydrocarbon producing zone 104.

The tubular member 110 can be one or more sections of pipe or tubular connected together. For example, the tubular member 110 can include multiple sections of tubular and the sections of tubular can be connected together. In certain embodiments, the multiple tubular sections of tubular member 110 can be coupled together by threaded connections, pressure fits, mechanical fasteners, welds, soldering, or like methods. The tubular member 110 can be configured to extend from an opening 103 of the wellbore 102 and dispose the wash pipe 170 and the screen assembly 180 adjacent the hydrocarbon producing zone 104. For example, the length and consequently the number of sections of tubular can be determined by logging information and/or other wellbore measurements.

The service tool 160 can be connected to an end of the tubular member 110 distal the opening 103. The service tool 160 can have one or more operations modes and/or configurations. For example, the service tool 160 can have a mode supporting wash down to the end of the wash pipe 170, a mode supporting circulation of fluids, a mode supporting production of hydrocarbons, and a mode supporting the injection of fluids into the hydrocarbon producing zone 104. The service tool 160 can be configured to provide a flow path between the inner bore of the tubular member 110 and an annulus 183 between the screen assembly 180 and the hydrocarbon producing zone 104. The service tool 160 can also be configured to provide a flow path between the inner diameter of the wash pipe 170 and an annulus 157 formed between the tubular member 110 and the wellbore 102 within the second zone 155. The service tool 160 can be a tubular having two or more flow ports (two are shown: 162 and 165). The service tool 160 can also have one or more flow control devices (not shown) connected thereto or integrated therewith. For example, one or more flow control devices can be disposed within or adjacent the flow ports 162, 165 and can selectively provide and/or prevent fluid flow through the flow ports 162, 165. Illustrative flow control devices can include pressure relief valves, ball valves, needle valves, sliding sleeves, or the like.

The flow ports 162, 165 can be radially formed through a portion of the service tool 160. For example, the flow ports 162, 165 can be formed into the service tool 160 by milling, drilling, gun drilling, or the like. The flow port 162 can be in selective fluid communication with the inner diameter of the wash pipe 170 and the annulus 157. The flow port 165 can be in selective fluid communication with the inner diameter of the tubular member 110 and the annulus 183.

The packer 120 can be any isolation packer and/or another downhole sealing device. Exemplary packers 120 can include compression or cup packers, inflatable packers, "control line bypass" packers, polished bore retrievable packers, swellable packers, other downhole packers, or combinations thereof. The packer 120 can be disposed about the tubular member 110 and/or the service tool 160. The packer 120 can isolate a portion of the wellbore 102 adjacent the hydrocarbon producing zone from the "upper" portions of the wellbore 102, such as the zones 150, 155. It will be appreciated that additional packers to isolate and allow for gravel packing of multiple zones in a wellbore.

The wash pipe 170 can be a tubular member or similar device. The wash pipe 170 can be located or disposed adjacent the hydrocarbon producing zone 104 when the tubular member 110 is located within the wellbore 102. The wash pipe 170 can be connected to a wash down shoe or mule shoe 177. The wash down shoe 177 can have one or more valves, such a poppet valves, configured to prevent flow through an inner diameter thereof. The wash down shoe 177 can isolate the hydrocarbon producing zone 104 from a lower portion of the wellbore 102. The wash pipe 170 can be disposed within the screen assembly 180, and a flow path 181 from an outer diameter of the screen assembly 180 and the inner diameter of the wash pipe 170 can be formed between the screen assembly 180 and the outer diameter of the wash pipe 170.

The screen assembly 180 can include a base pipe 182. The base pipe 182 can be blank pipe or a similar tubular, and can have one or more slits, perforations, holes, and/or other apertures formed radially therethrough, which can provide fluid communication between the outer diameter of the base pipe 182 and the flow path 181. The base pipe 182 can have a filter media 184 disposed about the outer diameter thereof. The filter media 184 can be a wire-wrapped screen, a mechanical-type screen, or combinations thereof or the like. The filter media 184 can be sized to allow fluids and or hydrocarbons to flow therethrough and to separate particulates and/or proppant from the fluids and/or hydrocarbons.

The fluid loss control device 175 can be connected to the packer 120 and the screen assembly 180. The fluid loss control device 175 can be a flapper valve, a ball valve, or a formation isolation valve. The fluid loss control device 175 can be configured to be actuated mechanically, electrically, hydraulically, or a combination thereof. The fluid loss control device 175 can isolate the inner diameter of the screen assembly 180 from the zones 150, 155 when the tubular member 110, service tool 160, wash pipe 170, and wash down shoe 177 are removed from the wellbore 102. For example, the fluid loss control device 175 can be closed by a collet (not shown) disposed on a portion of the wash pipe 170 when the wash pipe 170 is removed to prevent wellbore fluids in the zones 150, 155 from flowing into the inner diameter of the base pipe 180. Accordingly, the hydrocarbon producing zone 104 can be protected from contamination or damage due to exposure to well bore fluids in the zones 150, 155.

The seal device 130 can isolate the first zone 150 from the second zone 155. The seal device 130 can be any sealing mechanism capable of sealing an annulus 152 adjacent the hydrodynamic flow device 140. The sealing device 130 can at least partially isolate the first zone 150 from the second zone 155. The sealing device 130 can be or include one or more molded rubber seals, composite rubber seals, and/or elastomeric o-rings. The sealing device 130 can be configured to be retrievable. For example, the sealing device 130 can be configured to disengage the walls of the wellbore 102.

In one or more embodiments, the sealing device 130 can also be configured to provide a bypass flow path around the hydrodynamic flow device 140 to enable manipulation of the tubular member 110 relative to the wellbore 102. The bypass flow path can thus allow reverse flow through the sealing device 130, from the first zone 150 to the second zone 155 in the annulus 157, and then back out the tubular member 110. This can allow removal of any residual proppant 107 in the system 100 after the treatment process has been completed. In an exemplary embodiment, to reverse the flow, the service tool 160 can be moved up in the wellbore to expose the port 165 above the packer 120, thereby allowing fluid communication between the inner bore of the tubular member 110 and the annulus 157.

The hydrodynamic flow device 140 can be any device for transporting fluid materials. In one or more embodiments, the hydrodynamic flow device 140 can be sized and configured to provide a variable flow rate therethrough. In an exemplary embodiment, the hydrodynamic flow device 140 can include one or more pumps, for example, a centrifugal pump, a hydraulic pump, an electric pump, combinations thereof, or the like. Other exemplary pumps can include electric submersible pumps, single stage centrifugal pumps, and/or the like. In an exemplary embodiment, the hydrodynamic flow device 140 can include a multi-stage centrifugal pump, or multiple single-stage centrifugal pumps, or a combination of single and multi-stage centrifugal pumps, and a stage bypass system. The stage bypass system can bypass one or more of the compression stages of the included pump(s), thereby providing for the delivery of variable pressure flow through the discharge of the hydrodynamic flow device 140. The pump can be attached to a variable speed driver. Exemplary variable speed drivers can include variable speed motors and variable speed hydraulic motors.

The flow rate and pressure required to be delivered by the hydrodynamic flow device 140 can depend on the density of the fluid, the length of the wellbore 102, the length of the wash pipe 170, the length of the hydrocarbon producing zone 104, and other properties that can affect the pressure experienced by the hydrocarbon producing zone 104 and/or the wellbore 102. The flow rate through the hydrodynamic flow device 140 and/or the discharge pressure of the hydrodynamic flow device 140 can be selectively controlled to maintain a constant pressure within the wellbore 102, to maintain a constant flow rate of fluid into the wellbore 102, or both. The hydrodynamic flow device 140 can be arranged about the tubular member 110 such that an inlet 142 of the hydrodynamic flow device 140 is adjacent or within the second zone 155, and a discharge 146 of the hydrodynamic flow device 140 is adjacent the first zone 150. Accordingly, the hydrodynamic flow device 140 may also be known as, or include, an induced-flow pump.

The monitoring and control system 190 can monitor the discharge pressure of the hydrodynamic flow device 140, the pressure within the wellbore 102, and the flow rate of fluids into and out of the wellbore 102. The monitoring and control system 190 can be in communication with the hydrodynamic flow device 140, the service tool 160, and or other portions of the system 100 through wired or wireless telemetry. If wired telemetry is employed, it can include fiber optic lines, electrical lines, other wires, cables and combinations thereof. Wireless telemetry options can include acoustic waves, electromagnetic waves, radio frequency waves, radioactive proppant, pressure waves, vibrations and combinations thereof.

The monitoring and control system 190 can control the hydrodynamic flow device 140 and other portions of the system 100. For example, the control and monitor system 190 can have a processor that can receive measured data from the monitoring equipment, and send a signal to the hydrodynamic flow device 140 instructing the hydrodynamic flow device 140 to increase, decrease, or maintain the flow rate therethrough. As further explanation, the monitoring and control system 190 can communicate in two ways: actively and inherently. Active communication can take place via the described communication system which transfers information between the monitoring and control system 190 and hydrodynamic flow device 140 by way of wired and/or wireless telemetry. Inherent communication can be achieved via the fluid stream in zone 102 or zone 107, wherein the flow rate and pressure of the fluid in the zone 102 and the zone 107 can relay information to the monitoring and control system 190 about the current state of the hydrodynamic flow device 140. Accordingly, the monitor and control device 190 can include a pressure monitoring device 192, a flow rate monitoring device 194, and an adjustable choke 196. The monitor and control device 190 can have an exhaust 198 to atmospheric conditions.

The pressure monitoring device 192 can be an analog or digital pressure gauge. The pressure monitoring device 192 can include one or more Bragg pressure gauges, fiber optic pressure gauges, electrical pressure gauges, or other devices capable of measuring pressure. The pressure monitoring device 192 can be in communication with the hydrodynamic flow device 140, the flowrate monitoring device 194, the adjustable choke 196, and/or a processor integrated with or remote from the monitor and control device 190. The data acquired by the pressure monitoring device 192 can be communicated to the adjustable choke 192, the hydrodynamic flow device 140, and/or a processor integrated with or remote from the monitor and control device 190 and the discharge pressure of the hydrodynamic flow device 140 can be adjusted or controlled based on the transmitted data. For example, if the pressure monitoring device 192 measures a pressure below what is desired, the flow area through the adjustable choke 196 can be reduced to increase the pressure within the zone 150. Accordingly, the discharge pressure of the hydrodynamic flow device 140 can increase. The pressure monitoring device 192 may also be integrated with the flow rate monitoring device 194.

The flow rate monitoring device 194 can be a flow meter, a flow gauge, a multi-phase flow meter, or any other device capable of measuring the flow rate therethrough. The flow rate monitoring device 194 can be in communication with the hydrodynamic flow device 140, the adjustable choke 196, and/or a processor integrated with or remote from the control and monitor system 190. For example, the flow rate monitoring device 194 can send a signal to the hydrodynamic flow device 140 if a low flow rate is detected, and the signal can cause the hydrodynamic flow device 140 to increase the flow rate therethrough by increasing the speed of a variable speed driver operatively attached thereto, or by engaging additional compression stages, as described above.

The adjustable choke 196 can be adjusted, continuously or in discrete increments, to control the pressure drop therethrough and, thus, within the zone 150. The adjustable choke 196 can be a multi-position choke with variable flow area settings therethrough to control the pressure drop across it. For example, the adjustable choke 196 can have a flow area therethrough of 4 square inches in a first setting, 3 square inches in a second setting, 2 square inches in a third setting, 1 square inch in a fourth setting, 0.5 inches in a fifth setting, and the like. Other flow areas, including a continuously adjustable (i.e., non-discrete) flow area, through the adjustable choke 196 are possible. The adjustable choke 196 can be controlled and switched between the settings by mechanical, hydraulic (which, for the purposes of this disclosure, can include pneumatic), or electrical actuation means. Further, the adjustable choke 196 can be in communication with a control line (not shown) and can cycle between the settings in response to control signals of any kind known to one of skill in the art, such as pressure signals or electric signals, sent through the control lines.

Figure 2:
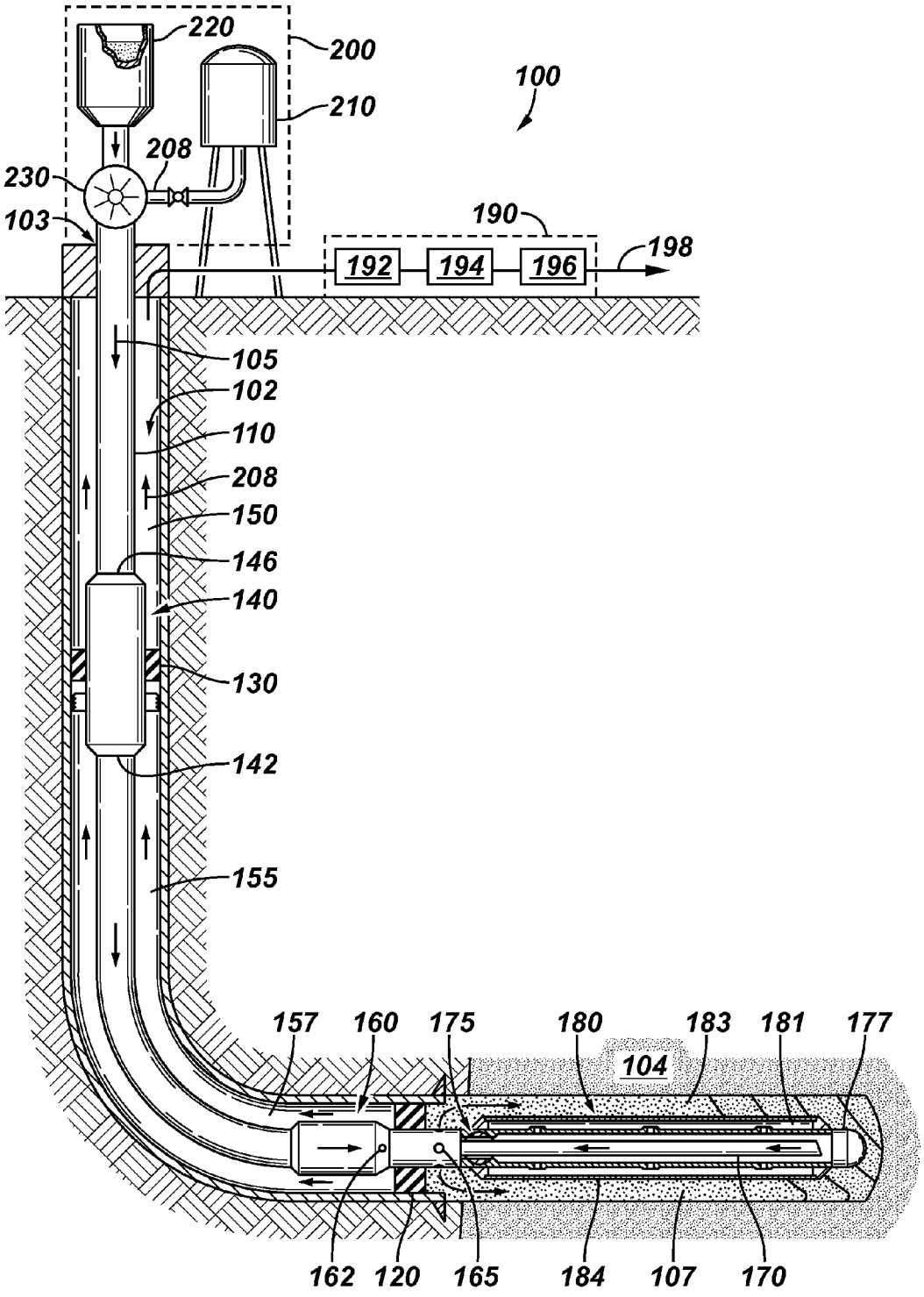
FIG. 2 depicts a schematic view of the system of FIG. 1 in fluid communication with an illustrative gravel slurry conveyance assembly, according to one or more embodiments described.

FIG. 2 depicts a schematic view of the system 100 in fluid communication with an illustrative gravel slurry conveyance assembly 200, according to one or more embodiments. The gravel slurry conveyance assembly 200 can include a fluid storage tank 210 and a proppant storage tank 220 in fluid communication with a blender 230. The fluid storage tank 210, the proppant storage tank 220, and the blender 230 can be adjacent the opening 103 of the wellbore 102. The gravel slurry conveyance assembly 200 can be in fluid communication with the system 100.

The fluid storage tank 210 can be any storage device capable of storing liquids. The carrier fluid 208 stored within the fluid storage tank 210 can be water or any other gravel slurry carrier fluid. In one or more embodiments, the specific gravity of the carrier fluid 208 can be adjusted to control the hydrostatic pressure within the wellbore 102. Accordingly, the specific gravity of the carrier fluid 208 can be increased to increase the pressure exerted into the hydrocarbon producing zone 104, and the specific gravity of the carrier fluid 208 can be decreased to reduce the pressure exerted to the hydrocarbon producing zone 104. The proppant storage tank 220 can be a silo or other container for storing solids. The proppant 207 stored in the proppant storage tank 220 can be any particulate matter. An illustrative proppant 207 is described in more detail in U.S. Pat. No. 6,582,819, the entirety of which is incorporated herein by reference to the extent it is not inconsistent with this disclosure.

The blender 230 can be any device capable of mixing the proppant 207 and the carrier fluid 208 together. An illustrative blender 230 is described in more detail in U.S. Pat. No. 7,387,159, the entirety of which is incorporated herein by reference to the extent it is not inconsistent with this disclosure. The blender 230 can mix the carrier fluid 208 and proppant 207 together to form the gravel slurry 205. The blender 230 can be in fluid communication with the tubular member 110 and can provide the gravel slurry 205 to the inner diameter of the tubular member 110. The gravel slurry 205 can flow within the inner diameter of the tubular member 110 to the service tool 160. The service tool 160 can flow the gravel slurry 205 to the annulus 183 adjacent the hydrocarbon producing zone 104 via the flow port 165.

In exemplary operation, the system 100 can be positioned within the wellbore 102. The wash pipe 170 and the screen assembly 180 can be located adjacent the hydrocarbon producing zone 104, and the packers 120 can be set isolating the annulus 183 adjacent the hydrocarbon producing zone 104 from other portions of the wellbore 102. The seal device 130 can be secured or set within the wellbore 102, thereby isolating the first zone 150 from the second zone 155. The gravel slurry conveyance assembly 200 can be connected or placed in fluid communication with the system 100 after the tubular member 110, the wash pipe 170, and the service tool 160 are located within the wellbore 102.

Carrier fluid 208 from the fluid storage tank 210 and proppant 207 from the proppant storage tank 220 can flow to the blender 230. Such flows may be propagated by any means useful for materials like carrier fluid 208 and proppant 207, and may be independent of each other. Examples of propagation methods include gravity flow, pumps, conveyors, belts and the like. The blender 130 mixes proppant 207 and carrier fluid 208 to form gravel slurry 205. Gravel slurry 205 flows from blender 230 to tubular member 110. The hydrodynamic flow device 140 can be operated to provide a constant flow rate of the gravel slurry 205 through the tubular member 110 by controlling the flow rate of the carrier fluid 208 circulating back to the surface, and, consequently, the pressure within the zones 150, 155, by providing an induced-flow system that eliminates the need to increase surface pumping pressure to overcome friction and hydrostatic pressure within the wellbore 102.

As the gravel slurry 205 is deposited within the annulus 183 about the screen assembly 180, the proppant 207 can pack about the screen assembly 180. The flow rate conveyed within the hydrocarbon producing zone 104 and any filter cake during the placement of the gravel slurry 205 is controlled by the hydrodynamic flow device 140. Accordingly, the friction pressure accumulated in the wash pipe 170 and inside the screen assembly 180, can be compensated for by the hydrodynamic flow device 140, to maintain generally constant pressure, which can be chosen as less than the formation or fracturing pressure. Thus, the pressure exerted on the filter cake and hydrocarbon producing zone 104 using system 100 can be maintained at less than the pressure exerted on the filter cake and hydrocarbon producing zone 104 using forced flow systems, by avoiding the ramping up of pressure during introduction of the gravel slurry, as described in further detail below.

The carrier fluid 208 can migrate through the filter media 184 to flow path 181. The migration of the carrier fluid 208 to the flow path 181 dehydrates the gravel slurry 105, and the proppant 207 packs about the screen assembly 180. Accordingly, the proppant 207 provides a filter that allows hydrocarbons from the hydrocarbon producing zone 104 to flow therethrough but filters sand commingled with the hydrocarbons. The proppant 207 can pack about the screen assembly 180, and the carrier fluid 208 can circulate out of the wellbore 102. For example, the carrier fluid 208 can flow along flow path 181 to the inner diameter of the wash pipe 170. The carrier fluid 208 can flow from the inner diameter of the wash pipe 170 to the annulus 157 within the second zone 155 via flow port 162. The carrier fluid 208 in the second zone 155 can flow through the inlet 142 to the discharge 146. The carrier fluid 208 can flow from the discharge 146 to the first zone 150. The carrier fluid 208 in the first zone 150 can flow to the control and monitor system 190 and the pressure monitor 192 and flow monitor 194 can measure the pressure and flow rate of the carrier fluid 208 exiting the zone 150. The carrier fluid 208 can flow through the adjustable choke 196 and exit the control monitor system 190 via exhaust 198 to atmospheric conditions. The adjustable choke 196 can be adjusted based on the measured pressure of the carrier fluid 208 exiting the zone 150.

Figure 3:
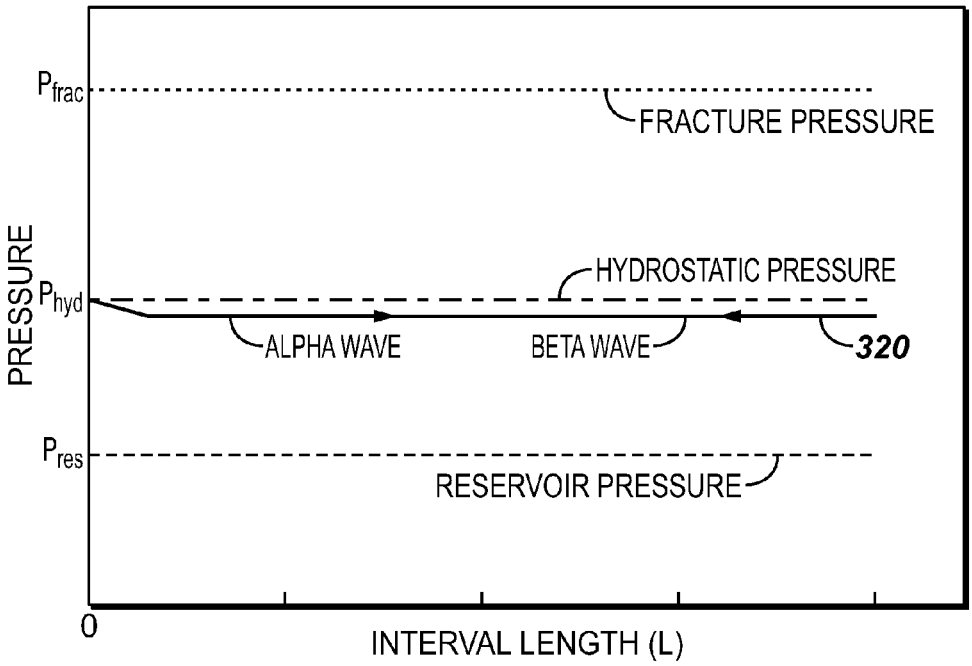
FIG. 3 depicts a graphical representation of an illustrative pressure profile for the system of FIG. 1, according to one or more embodiments described.

FIG. 3 depicts a graphical representation of an illustrative pressure profile for the system, according to one or more embodiments. Referring additionally to FIG. 2, the pressure response at the hydrocarbon producing zone 104 can be maintained constant throughout gravel pack operations using the system 100 or a system substantially similar thereto. The system 100 can convey gravel slurry 205 into the wellbore 102 and maintain the pressure at the hydrocarbon producing zone 104, which is represented by line 320, constant throughout the Alpha and Beta phase of the gravel pack operation. The pressure at the hydrocarbon producing zone 104 can be held below hydrostatic pressure due to the fluid friction in the tubular member 110 and/or selective operation of the hydrodynamic flow device 140. In one or more embodiments, the hydrodynamic flow device 140 or conditions within the first zone 150 can be controlled to maintain the pressure at the hydrocarbon producing zone 104 below hydrostatic conditions. For example, as resistance to the flow of the gravel slurry 205 into the wellbore 102 increases due to increased friction force in portions of the system 100, such as in flowpath 181, the discharge pressure of the hydrodynamic flow device 140 can be varied or the flow rate of circulating carrier fluid 208 through the hydrodynamic flow device 140 can be increased to maintain the pressure below hydrostatic pressure.

Figure 4:
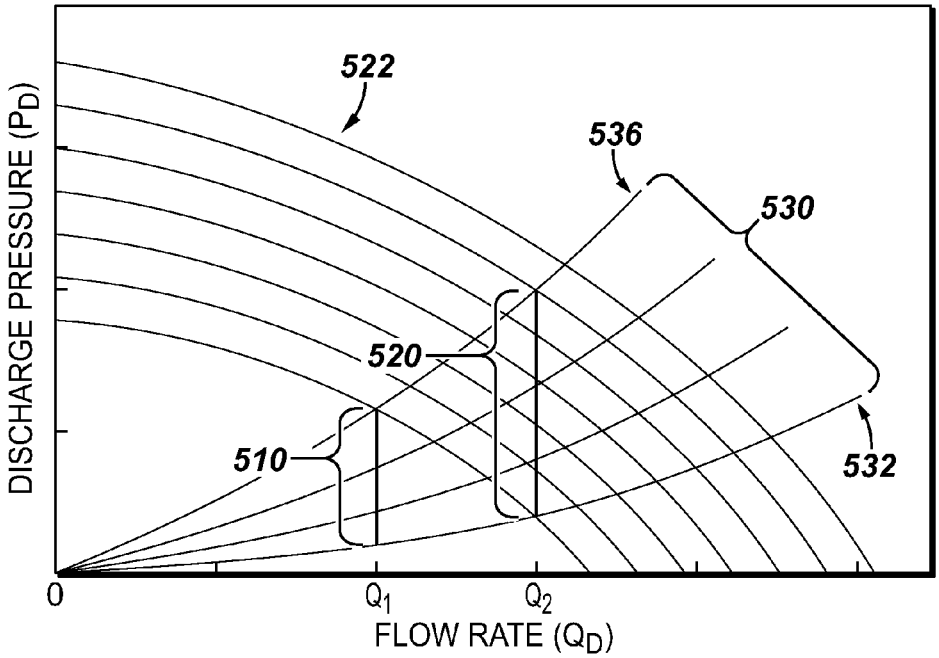
FIG. 4 depicts a graphical representation of illustrative processes for controlling pressure changes between two phases of a gravel pack operation and maintaining a steady flow rate using the system of FIG. 1, according to one or more embodiments described.

FIG. 4 depicts a graphical representation of illustrative processes for controlling pressure changes between two phases of a gravel pack operation and maintaining a steady flow rate using the system 100 of FIGS. 1 and 2, according to one or more embodiments. The system resistance 530 increases during a gravel pack operation from an Alpha phase resistance 532 to an ending Beta phase resistance 536. The change in system resistance 530 between the Alpha phase resistance 532 and ending Beta phase resistance 536 can be accommodated to maintain the pressure at a hydrocarbon producing zone 104 constant or within a specific range by process 510, 520.

The process 510 controls the pressure at the hydrocarbon producing zone 104 by throttling the pressure difference between the Alpha phase resistance 532 and the ending Beta phase resistance 536 through a choke or other flow control device. The process 520 controls the pressure at the hydrocarbon producing zone 104 by increasing a flow rate through a hydrodynamic flow device 140 until the hydrodynamic flow device curve 522 matches the Beta phase resistance 536. The flow rate of gravel slurry into the wellbore and deposition of the gravel slurry adjacent the hydrocarbon producing zone 104 remains constant during process 510, 520.

Figure 5:
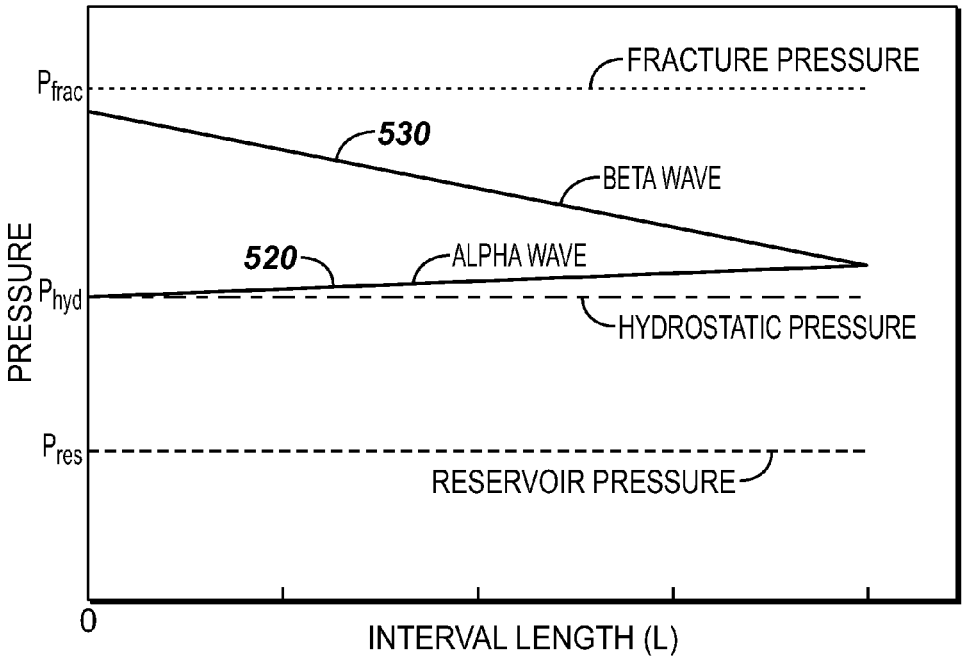
FIG. 5 depicts a graphical representation of an illustrative pressure profile for an Alpha/Beta water pack forced flow system, according to one or more embodiments described.

Forced flow systems overcome the hydrostatic pressure and friction pressure created during the Alpha phase and Beta phase by increasing the pressure of the gravel slurry and, thus, the pressure experienced by the reservoir and filter cake. FIG. 5 depicts a graphical representation of an illustrative pressure profile for an Alpha/Beta water pack forced flow system, according to one or more embodiments. Alpha deposition pressure curve 520 shows that the pressure at a hydrocarbon producing zone 104 steadily increases during the Alpha deposition of a gravel slurry. The pressure increases at a greater rate during the Beta deposition of the gravel slurry as shown by Beta deposition pressure curve 530. The greater rate of pressure increase shown by the Beta deposition pressure curve 530 is mainly due to an increase in friction pressure in an annulus between a wash pipe and an inner diameter of a filter media. The pressure continues to increase during the Beta deposition of the gravel slurry until one of the following occurs: the treatment is completed; the well is fractured; or treatment is terminated due to premature screen out of the gravel slurry in the wellbore. Accordingly, the forced flow system can not maintain a constant pressure at the hydrocarbon producing zone 104 while maintaining a constant flow rate.

Figure 6:
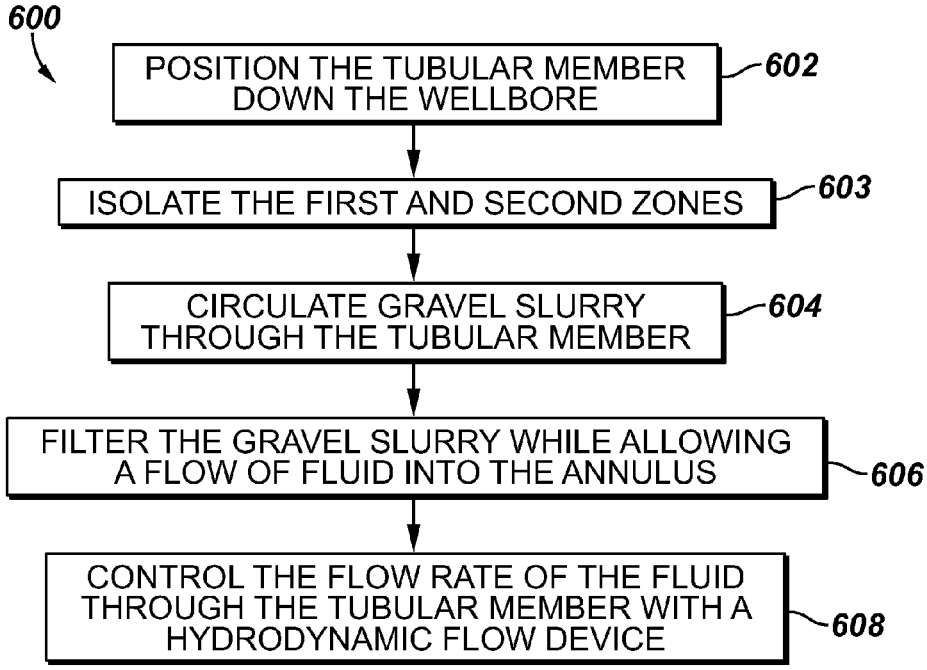
FIG. 6 depicts a flow chart of an exemplary method of gravel packing a wellbore, according to one or more embodiments described.

FIG. 6, with additional reference to FIGS. 1 and 2, illustrates a flow chart of an exemplary method 600 of gravel packing a wellbore 102. The tubular member 110 can be positioned down the wellbore 102, shown at 602, for example, through a first zone 150, a second zone 155, and a hydrocarbon producing zone 104. The first and second zones can be isolated, as at 603, from each other (i.e., sealed) with, for example, the sealing device 130. A gravel slurry can be circulated through the tubular member 110, as at 604, for example, into a wash pipe 170 and through an opening in the wash pipe 170 into a filter media 184. The gravel slurry can be filtered with the filter media 184 to gravel pack an area inside of the filter media while allowing the flow of a fluid therethrough into annulus between the tubular member and the wellbore, as at 606. The flow rate of the fluid flowing through the tubular member 110 can be controlled by adjusting the discharge pressure of a hydrodynamic flow device 140, as at 608. The hydrodynamic flow device 140 can be positioned around or in the tubular member 110 in the wellbore 102, as described above. Controlling the flow rate of the fluid through the tubular member 110 with the hydrodynamic flow device 140 can control pressure in the annulus. For example, the pressure can be controlled so that it remains relatively stable and below a fracture pressure of the formation.

In an exemplary embodiment, the pressure in or adjacent the hydrocarbon producing zone 104 can be maintained below hydrostatic pressure within the wellbore 102 with the hydrodynamic flow device 140, thereby drawing the fluid away from the hydrocarbon producing zone 104. Further, the method 600 can include adjusting the flow rate through the tubular member 110, which can include increasing or decreasing the speed of the hydrodynamic flow device 140 until a flow rate through the hydrodynamic flow device 140 approximately matches a system Beta phase resistance. Additionally, adjusting the discharge pressure of the hydrodynamic flow device 140 can further include adjusting an adjustable choke in fluid communication with first zone, as described above. Moreover, the method 600 can also include bypassing the sealing device 130 to reverse out a slurry and a residual proppant after circulating the gravel slurry through the tubular member.

As used herein, the terms "up" and "down;" "upper" and "lower;" "upwardly" and downwardly;" "upstream" and "downstream;" and other like terms are merely used for convenience to depict spatial orientations or spatial relationships relative to one another in a vertical wellbore. However, when applied to equipment and methods for use in wellbores that are deviated or horizontal, it is understood to those of ordinary skill in the art that such terms are intended to refer to a left to right, right to left, or other spatial relationship as appropriate.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A system for conveying fluid into a wellbore, comprising:

a tubular member disposed in the wellbore through a first zone, a second zone, and a hydrocarbon producing zone of the wellbore;

a packer disposed adjacent to the tubular member in the wellbore, wherein the packer is configured to at least partially isolate the hydrocarbon producing zone from at least one of the first and second zones;

a hydrodynamic flow device disposed around the tubular member at a position between the packer and a surface location, the hydrodynamic flow device comprising a pump fluidly connected to a discharge in fluid communication with the first zone and an inlet in fluid communication with the second zone;

a seal device disposed around the hydrodynamic flow device to isolate a first annulus of the first zone from a second annulus of the second zone; and a monitor and control system by which the hydrodynamic flow device is controlled to adjust flow of fluid therethrough in a manner which maintains pressure in the hydrocarbon producing zone below hydrostatic pressure in the wellbore.

2. The system of claim 1, wherein the pump of the hydrodynamic flow device comprises a centrifugal pump, a hydraulic pump, or an electrical pump.

3. The system of claim 1, wherein a pressure in the first zone of the wellbore, a flow rate through the hydrodynamic flow device, or both are controlled by the monitor and control system to maintain a constant flow rate through the tubular member, a constant pressure at the hydrocarbon producing zone, or both.

4. The system of claim 3, wherein the wellbore is monitored by the monitor and control system, and the monitor and control system is in communication with the hydrodynamic flow device via wireless telemetry.

5. The system of claim 3, wherein the monitor and control system comprises a pressure monitoring device, a flow monitoring device, or both in fluid communication with an adjustable choke.

6. An apparatus for controlling pressure in a wellbore, comprising:

a tubular member disposed in the wellbore through a first zone, a second zone, and a hydrocarbon producing zone of the wellbore and in fluid communication with a source of a proppant;

a hydrodynamic flow device disposed in the wellbore and around the tubular member and comprising a pump having a discharge in fluid communication with the first zone and an inlet in fluid communication with the second zone;

a service tool disposed on the tubular member, distal the hydrodynamic flow device, having a flow port defined therein in fluid communication with an annulus defined between the tubular member and the wellbore;

a wash pipe adjacent the service tool, wherein the wash pipe has an inner diameter in fluid communication with the flow port;

a filter media disposed about the wash pipe, wherein the inner diameter of the wash pipe is in fluid communication with an exterior of the filter media such that a liquid flowing radially inwardly through the filter media enters a distal end of the wash pipe and flows longitudinally through the wash pipe until exiting into the annulus through the flow port; and a control and monitoring system controlling the hydrodynamic flow device to regulate pressure in the hydrocarbon producing zone from a position outside the hydrocarbon producing zone.

7. The apparatus of claim 6, wherein the source of the proppant comprises:

a fluid storage tank adjacent the wellbore;

a proppant storage tank adjacent the wellbore; and a blender in fluid communication with the proppant storage tank, the fluid storage tank, and the tubular member.

8. The apparatus of claim 7, further comprising:

a seal device disposed around the hydrodynamic flow device to isolate the first zone from the second zone; and a packer adjacent the tubular member, wherein the packer is configured to at least partially isolate a portion of the wellbore adjacent the hydrocarbon producing zone from at least another portion of the wellbore.

9. The apparatus of claim 6, wherein the control and monitoring system is in fluid communication with the first zone and comprises a pressure monitoring device and a flow monitoring device, wherein the pressure monitoring device and the flow monitoring device are in fluid communication with an adjustable choke.

10. The apparatus of claim 6, wherein the pump of the hydrodynamic flow device comprises a centrifugal pump, a hydraulic pump, or an electrical pump.

11. A method of gravel packing a wellbore, comprising:

positioning a tubular member down the wellbore through a first zone, a second zone distal the first zone, and a hydrocarbon producing zone;

isolating the first zone from the second zone with a sealing device;

circulating a gravel slurry through the tubular member and out through an opening into an area outside of a filter media;

filtering the gravel slurry with the filter media to gravel pack the area outside of the filter media while allowing a flow of fluid therethrough into a wash pipe and subsequently into an annulus between the tubular member and the wellbore; and controlling a flow rate through the tubular member to control a pressure in the hydrocarbon producing zone, comprising adjusting a discharge pressure of a hydrodynamic flow device positioned on the tubular member outside of the hydrocarbon producing zone, the hydrodynamic flow device having a discharge in communication with the first zone and an inlet in fluid communication with the second zone.

12. The method of claim 11, wherein controlling the flow rate through the tubular member to control the pressure in the hydrocarbon producing zone further comprises maintaining the pressure below a hydrostatic pressure in the wellbore.

13. The method of claim 11, wherein adjusting a discharge pressure of the hydrodynamic flow device comprises increasing a speed of fluid flowing through the hydrodynamic flow device until the pressure of the fluid matches a system Beta phase resistance.

14. The method of claim 11, wherein adjusting the discharge pressure of the hydrodynamic flow device comprises adjusting an adjustable choke in fluid communication with the first zone.

15. The method of claim 11, further comprising bypassing the sealing device to reverse out a slurry and a residual proppant after circulating the gravel slurry through the tubular member.

16. A method of gravel packing a wellbore, comprising:

positioning a tubular member with a hydrodynamic flow device disposed around the tubular down the wellbore through a first zone, a second zone distal the first zone, and a hydrocarbon producing zone, wherein a first zone annulus and a second zone annulus is formed between the tubular member and the wellbore, and wherein the hydrodynamic flow device comprises a pump fluidly connected to a discharge in fluid communication with the first zone annulus and an inlet in fluid communication with the second zone annulus;

isolating the first zone from the second zone with a sealing device;

isolating the hydrocarbon producing zone with a packer;

circulating a gravel slurry through the tubular member and out through an opening into an area outside of a filter media;

filtering the gravel slurry with the filter media to gravel pack with proppant from the gravel slurry the area outside of the filter media in a producing zone annulus between the filter media and the wellbore while allowing filtered carrier fluid to flow into a wash pipe located radially inward of the filter media, into the annulus above the packer, through the inlet of the hydrodynamic flow device, out of the outlet of the hydrodynamic device, and to the surface of the wellbore; and controlling a flow rate of gravel slurry through the tubular member while circulating gravel slurry through the tubular member to the filter media to control a pressure in the hydrocarbon producing zone, comprising adjusting a discharge pressure of a discharge of a hydrodynamic flow device positioned on the tubular member and having a discharge in communication with the first zone and an inlet in fluid communication with the second zone.

17. The method of claim 16, further comprising after packing gravel about the filter media removing gravel slurry in the tubular, wherein removing gravel slurry in the tubular comprises bypassing the sealing device, opening a port above the packer to provide fluid communication between the inner bore of the tubular member and the second zone annulus, of the packer, pumping fluid from the surface down the first zone annulus, past the seal of the hydrodynamic flow device, down the second zone annulus, into the port, and up the inner bore of the tubular member so as to remove gravel slurry in the tubular.

18. The method of claim 17, wherein bypassing the sealing device comprises disengaging the sealing device from the walls of the wellbore.

19. The method of claim 16, further comprising controlling the hydrodynamic flow device to maintain a constant pressure within the wellbore.

20. The method of claim 16, further comprising controlling the hydrodynamic flow device to maintain a constant flow rate of fluid into the wellbore.

21. The method of claim 16, further comprising monitoring a parameter in the wellbore, wherein the hydrodynamic flow device is controlled to adjust flow rate through the hydrodynamic flow device in response to the monitored parameter.

22. The method of claim 21, wherein monitoring comprises monitoring fluid pressure.

23. The method of claim 22, further comprising controlling the hydrodynamic flow device to adjust flow to maintain fluid pressure in the wellbore less than the fracturing pressure of the wellbore.

* * * * *